US011101062B2

(12) United States Patent
Aoki et al.

(10) Patent No.: US 11,101,062 B2
(45) Date of Patent: Aug. 24, 2021

(54) COIL COMPONENT

(71) Applicant: TAIYO YUDEN CO., LTD., Tokyo (JP)

(72) Inventors: Hidenori Aoki, Tokyo (JP); Tomoo Kashiwa, Tokyo (JP)

(73) Assignee: TAIYO YUDEN CO, , LTD., Tokyo (JP)

( * ) Notice: Subject to any disclaimer, the term of this patent is extended or adjusted under 35 U.S.C. 154(b) by 248 days.

(21) Appl. No.: 15/926,648

(22) Filed: Mar. 20, 2018

(65) Prior Publication Data

US 2018/0286555 A1 Oct. 4, 2018

(30) Foreign Application Priority Data

Mar. 29, 2017 (JP) ..... JP2017-065319

(51) Int. Cl.
*H01F 27/24* (2006.01)
*H01F 27/02* (2006.01)
(Continued)

(52) U.S. Cl.
CPC ..... *H01F 27/022* (2013.01); *H01F 17/045* (2013.01); *H01F 27/24* (2013.01);
(Continued)

(58) Field of Classification Search
CPC .. H01F 27/022; H01F 27/2828; H01F 17/045; H01F 27/292; H01F 27/24;
(Continued)

(56) References Cited

U.S. PATENT DOCUMENTS 6,154,112 A * 11/2000 Aoba ..... H01F 27/292 336/185
6,388,550 B1 * 5/2002 Kanetaka ..... H01F 17/0033 29/602.1
(Continued)

FOREIGN PATENT DOCUMENTS

CN 101441929 A 5/2009
CN 106057437 A 10/2016
(Continued)

OTHER PUBLICATIONS

Rejection Decision dated Jan. 25, 2019 issued in corresponding Chinese Patent Application No. 107107627 with English translation.
(Continued)

*Primary Examiner* — Tuyen T Nguyen
(74) *Attorney, Agent, or Firm* — Pillsbury Winthrop Shaw Pittman, LLP

(57) ABSTRACT

One object is to provide a new improvement for increasing an effective magnetic permeability of a coil component. A coil component according to one embodiment of the present invention includes a drum core having a first flange, a second flange, and a winding core coupling said first flange to said second flange, a winding wire wound on the winding core, and an exterior portion provided around the winding core so as to cover at least part of the winding wire. Said exterior portion has an easy magnetization direction oriented parallel to an axis of the winding core.

10 Claims, 10 Drawing Sheets

(51) Int. Cl.

| | |
|---|---|
| ***H01F 41/12*** | (2006.01) |
| ***H01F 41/06*** | (2016.01) |
| ***H01F 27/28*** | (2006.01) |
| ***H01F 17/04*** | (2006.01) |
| ***H01F 27/29*** | (2006.01) |
| *H01F 17/00* | (2006.01) |

(52) U.S. Cl.
CPC ..... *H01F 27/2823* (2013.01); *H01F 27/2828* (2013.01); *H01F 27/292* (2013.01); *H01F 41/06* (2013.01); *H01F 41/127* (2013.01); *H01F 2017/0093* (2013.01); *H01F 2017/048* (2013.01)

(58) Field of Classification Search
CPC .... H01F 41/127; H01F 41/06; H01F 27/2823; H01F 2017/048; H01F 2017/0093; H01F 27/306; H01F 27/324
See application file for complete search history.

(56) References Cited

U.S. PATENT DOCUMENTS

| | | | | |
|---|---|---|---|---|
| 6,535,095 | B2 * | 3/2003 | Aoki | H01F 17/045 336/200 |
| 7,215,232 | B2 * | 5/2007 | Aoki | H01F 17/045 336/83 |
| 7,495,538 | B2 * | 2/2009 | Tsunemi | H01F 3/10 336/84 M |
| 7,623,014 | B2 * | 11/2009 | Hsieh | H01F 17/045 336/185 |
| 7,859,377 | B2 * | 12/2010 | Kawarai | H01F 17/0006 336/83 |
| 8,975,997 | B2 * | 3/2015 | Tonoyama | H01F 27/255 336/200 |
| 2009/0058588 | A1 | 3/2009 | Suzuki et al. | |
| 2011/0117948 | A1 | 5/2011 | Ishii et al. | |
| 2016/0307686 | A1 | 10/2016 | Moon et al. | |
| 2018/0218817 | A1 * | 8/2018 | Kobayashi | H01F 5/06 |
| 2018/0268982 | A1 * | 9/2018 | Sturcken | H01F 27/24 |
| 2019/0027288 | A1 * | 1/2019 | Sato | H01F 5/04 |

FOREIGN PATENT DOCUMENTS

| | | | | | |
|---|---|---|---|---|---|
| JP | 58-147221 | U | | 10/1983 | |
| JP | 59-44013 | U | | 3/1984 | |
| JP | H11-67522 | A | | 3/1999 | |
| JP | 2007-273532 | A | | 10/2007 | |
| JP | 2008-053670 | A | | 3/2008 | |
| JP | 2008-166419 | A | | 7/2008 | |
| JP | 2009-009985 | A | | 1/2009 | |
| JP | 2009-200456 | A | | 9/2009 | |
| JP | 2009200456 | A | * | 9/2009 | H01F 17/045 |
| JP | 2014-099501 | A | | 5/2014 | |
| JP | 2016-031960 | A | | 3/2016 | |

OTHER PUBLICATIONS

Non-final Office Action dated Aug. 24, 2018 issued in corresponding Chinese Patent Application No. 107107627 with English translation.
Rejection Decision dated Jan. 25, 2019 issued in corresponding Taiwanese Patent Application No. 107107627 with English translation.
Non-final Office Action dated Aug. 24, 2018 issued in Chinese corresponding Taiwanese Patent Application No. 107107627 with English translation.
Non-final Office Action dated Apr. 30, 2019 issued in corresponding Korean Patent Application No. 10-2018-0029519 with English translation.
Office Action dated Nov. 15, 2019 issued in Taiwanese Patent Application No. 107107627 w/English translation (16 pgs.).
Office Action dated Nov. 28, 2019 issued in Korean Patent Application No. 10-2018-0029519 w/English translation (7 pgs.).
Notice of Reasons for Refusal dated Feb. 2, 2021 issued in corresponding Japanese Patent Application No. 2017-065319 with English language translation (9 pgs.).

* cited by examiner

COIL COMPONENT

CROSS-REFERENCE TO RELATED APPLICATIONS

This application is based on and claims the benefit of priority from Japanese Patent Application Serial No. 2017-065319 (filed on Mar. 29, 2017), the contents of which are hereby incorporated by reference in their entirety.

TECHNICAL FIELD

The present invention relates to a coil component. The present invention relates more specifically to a wire-wound coil component having a winding wire wound on a drum core.

BACKGROUND

Various coil components are used in electronic equipment. Examples of such a coil component include an inductor and a transformer. An inductor is used to, for example, eliminate noise from a signal.

Conventionally, a wire-wound coil component is known. A wire-wound coil component is provided with a drum core, a winding wire wound around the drum core, and a plurality of external electrodes electrically connected to end portions of the winding wire. The drum core has a pair of flanges and a winding core coupling said pair of flanges to each other. The winding wire is wound around said winding core.

In the conventional coil component, an exterior body is provided between the pair of flanges so as to cover the winding wire. The exterior body is made typically of a thermosetting resin such as an epoxy resin. In order to increase an effective magnetic permeability of the coil component, the exterior body may possibly be formed by using a resin into which filler particles such as of a ferrite powder are mixed.

For example, Japanese Patent Application Publication No. 2007-273532 and Japanese Patent Application Publication No. 2014-099501 disclose a coil component provided with an exterior body containing such filler particles.

It is desired that a coil component achieve a high inductance with a reduced number of wiring turns so that the coil component can be reduced in size. Also in a coil component provided with an exterior body containing filler particles, it is desired to achieve a high inductance by further increasing an effective magnetic permeability. A possible way of increasing an effective magnetic permeability is to increase a content ratio of the filler particles in the exterior body.

With an increased ratio of the filler particles to a resin in the exterior body, however, since said filler particles have an adhesive force extremely low compared with that of said resin, it becomes likely that said exterior body is peeled off from a drum core. Furthermore, when the resin in the exterior body is thermally cured, the filler particles do not thermally shrink (the resin in the exterior body has a linear expansion coefficient significantly larger than that of the filler particles), so that stress is exerted from said filler particles on said resin. Moreover, when the coil component is in use, thermal stress may possibly be generated in the exterior body thereof, and also in that case, stress is exerted from the filler particles on the resin. These types of stress can also constitute a cause of peeling of the exterior body from the drum core. For these reasons, a content ratio of the filler particles in the exterior body can only be increased to such an extent as not to cause peeling of the exterior body. As thus described, there is restriction on an approach to increasing an effective magnetic permeability by increasing a content ratio of filler particles in an exterior body.

SUMMARY

With this in view, it is an object of the present invention to provide a new improvement for increasing an effective magnetic permeability of a coil component. Specifically, one object of the present invention is to increase an effective magnetic permeability of a coil component provided with an exterior body without enhancing peeling of said exterior body. More specifically, one object of the present invention is to increase an effective magnetic permeability of a coil component provided with an exterior body containing filler particles without increasing a content ratio of said filler particles. Other objects of the present invention will be apparent with reference to the entire description in this specification.

A coil component according to one embodiment of the present invention is provided with a drum core having a first flange, a second flange, and a winding core coupling said first flange to said second flange, a winding wire wound on the winding core, and an exterior portion provided around the winding core so as to cover at least part of the winding wire. Said exterior portion has an easy magnetization direction oriented parallel to an axis of the winding core.

According to said embodiment, in the exterior portion, an orientation of magnetic flux and an easy magnetization direction of said exterior portion can be made to agree with each other. With this configuration, it is possible to increase an effective magnetic permeability of the coil component according to said embodiment.

In the coil component according to one embodiment of the present invention, the exterior portion contains a resin and a plurality of filler particles having a flat shape. In said embodiment, each of said plurality of filler particles is contained in the exterior portion so that a longest axis thereof is oriented in the direction parallel to the axis of the winding core.

According to said embodiment, by use of the filler particles contained in the exterior portion, it is possible to increase an effective magnetic permeability of said coil component. According to said embodiment, shape anisotropy is imparted to the filler particles (that is, the filler particles are formed in a flat shape), and thus it is possible to increase an effective magnetic permeability of the coil component without increasing a content ratio of the filler particles in the exterior portion. For example, based on a comparison between the coil component according to said embodiment and a conventional coil component provided with an exterior portion containing filler particles having no shape anisotropy (for example, filler particles in a spherical shape), the coil component according to the above-described embodiment of the present invention has a higher effective magnetic permeability when a content ratio of the filler particles in the exterior portion is the same in both the coil components. In the coil component provided with the exterior portion containing filler particles having no shape anisotropy, achieving an effective magnetic permeability equivalent to an effective magnetic permeability of the coil component according to the above-described embodiment requires that a content ratio of the filler particles in the exterior portion be increased (in terms of volume ratio). With an increased content ratio (in terms of volume ratio) of the filler particles in the exterior portion, however, since the resin in the exterior portion has a linear expansion coefficient significantly larger than that of the filler particles therein, when the resin in the exterior portion is thermally cured or when the coil component is in use, increased stress is exerted from the filler particles on the resin. Further, due to this stress, it becomes likely that said exterior portion is peeled off from a drum core or a winding wire. In contrast, in the coil component according to the above-described embodiment, the filler particles having shape anisotropy are arranged in the resin in the exterior portion, and thus a content of the resin in the direction parallel to the axis of the winding core is lower than a content of the resin in a direction perpendicular to the axis of the winding core. Consequently, a linear expansion coefficient of the exterior portion in the direction parallel to the axis of the winding core can be made smaller than a linear expansion coefficient of the exterior portion in the direction perpendicular to the axis of the winding core, and thus stress is also decreased. Thus, it can be said that compared with the conventional coil component provided with the exterior portion containing filler particles having no shape anisotropy and having an equivalent effective magnetic permeability, the exterior portion is hardly peeled off from the drum core.

According to the above-described embodiment, the longest axis of the filler particles is oriented in the direction parallel to the axis of the winding core, and thus compared with a case where filler particles are arranged in any other orientation, it is possible to suppress occurrence of an eddy current in the filler particles. With this configuration, it is possible to suppress a deterioration in quality factor of the coil component caused by an eddy current generated in the exterior portion.

The coil component according to one embodiment of the present invention is configured so that the winding core extends in a direction parallel to a principal surface of the coil component.

According to said embodiment, a landscape-oriented coil component can be obtained.

The coil component according to one embodiment of the present invention is configured so that the axis of the winding core extends in a short-side direction of the principal surface.

According to said embodiment, compared with a coil component in which an axis of a winding core extends in a long-side direction of a principal surface thereof, it is unlikely that breakage of the winding core occurs due to stress applied from a mounter at a time of mounting to a circuit substrate or bending stress received from the circuit substrate after mounting.

The coil component according to one embodiment of the present invention is provided further with a first external electrode provided on the first flange and electrically connected to one end portion of the winding wire and a second external electrode provided on the first flange and electrically connected to the other end portion of the winding wire.

According to said embodiment, both ends (a winding start end and a winding finish end) of the winding wire can be disposed at one of a pair of flanges (namely, the first flange) of the drum core. With this configuration, the winding wire can be wound around the winding core so as to be superimposed in an even number of tiers (two tiers, four tiers, six tiers, etc).

In one embodiment of the present invention, each of the first flange and the second flange is configured so that a thickness thereof in a direction perpendicular to the principal surface is larger than a thickness thereof in the direction parallel to the axis of the winding core.

According to said embodiment, in a case where stress in a direction perpendicular to a mounting surface is exerted on said first flange and second flange, it is unlikely that destruction occurs in said first flange and second flange.

In one embodiment of the present invention, the winding wire is wound on the winding core only in one tier.

According to said embodiment, it is possible to suppress occurrence of a stray capacitance between turns of the winding wire.

Advantages

Through various embodiments of the present invention, there is provided a new improvement in increasing an effective magnetic permeability of a coil component.

DESCRIPTION OF THE PREFERRED EMBODIMENTS

By appropriately referring to the appended drawings, the following describes various embodiments of the present invention. Constituent components common to a plurality of drawings are denoted by the same reference signs throughout said plurality of drawings. It is to be noted that, for the sake of convenience of description, the drawings are not necessarily depicted to scale.

Figure 1:
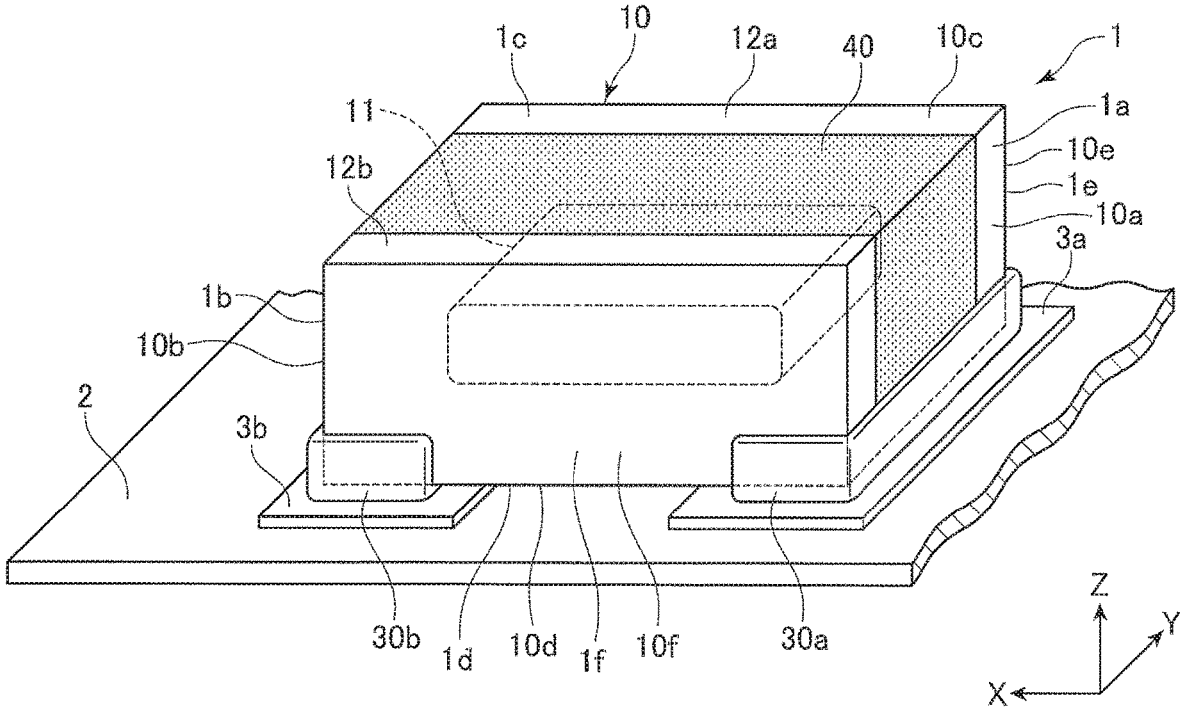
FIG. 1 is a perspective view showing a coil component according to one embodiment of the present invention.
Figure 2:
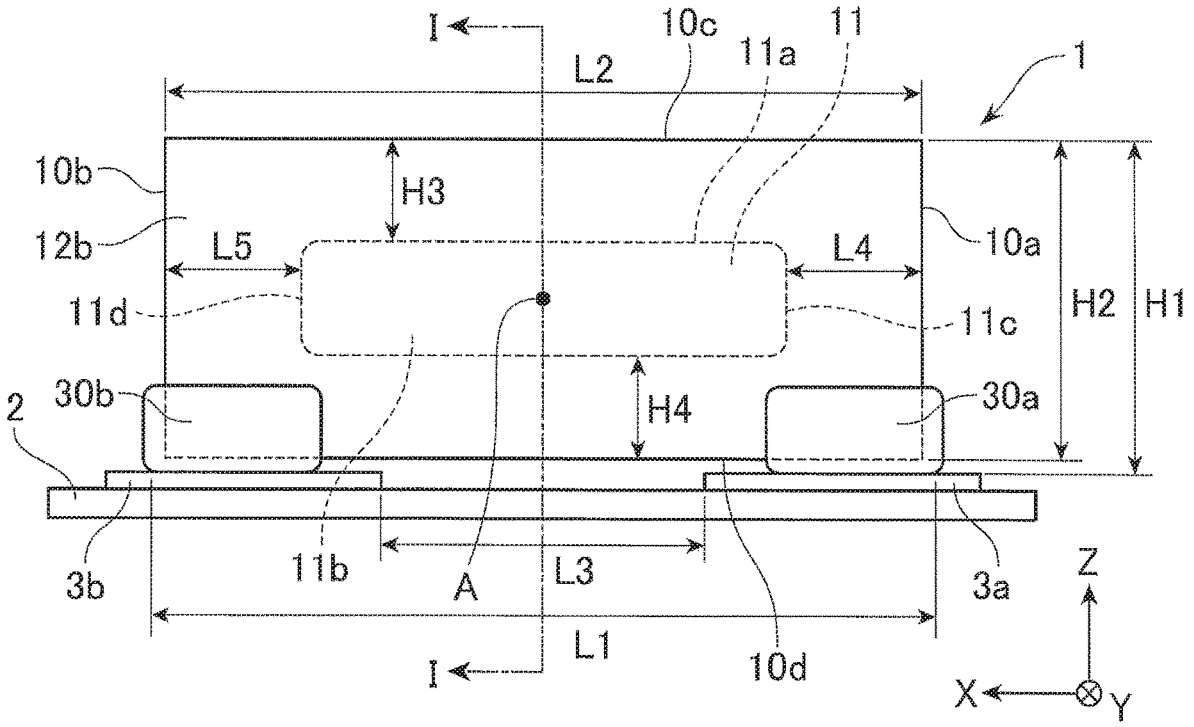
FIG. 2 is a front view of the coil component shown in FIG. 1.
Figure 3:
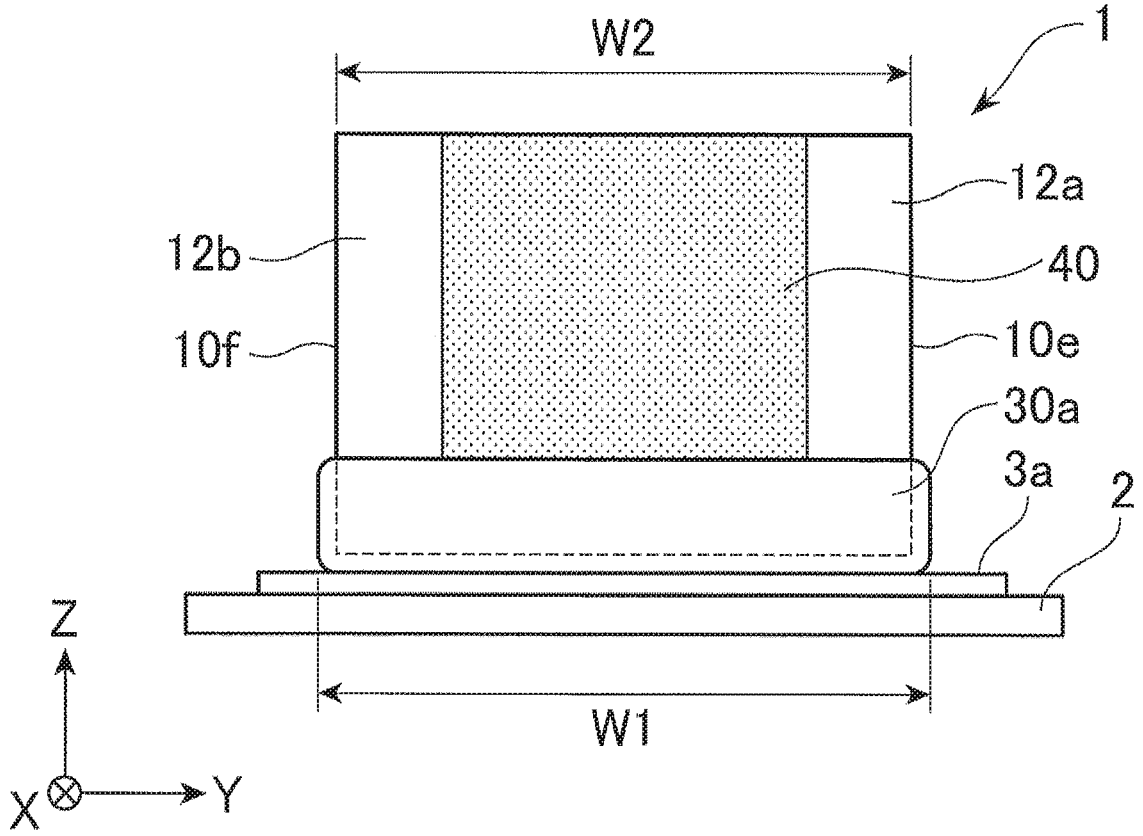
FIG. 3 is a right side view of the coil component shown in FIG. 1.
Figure 4:
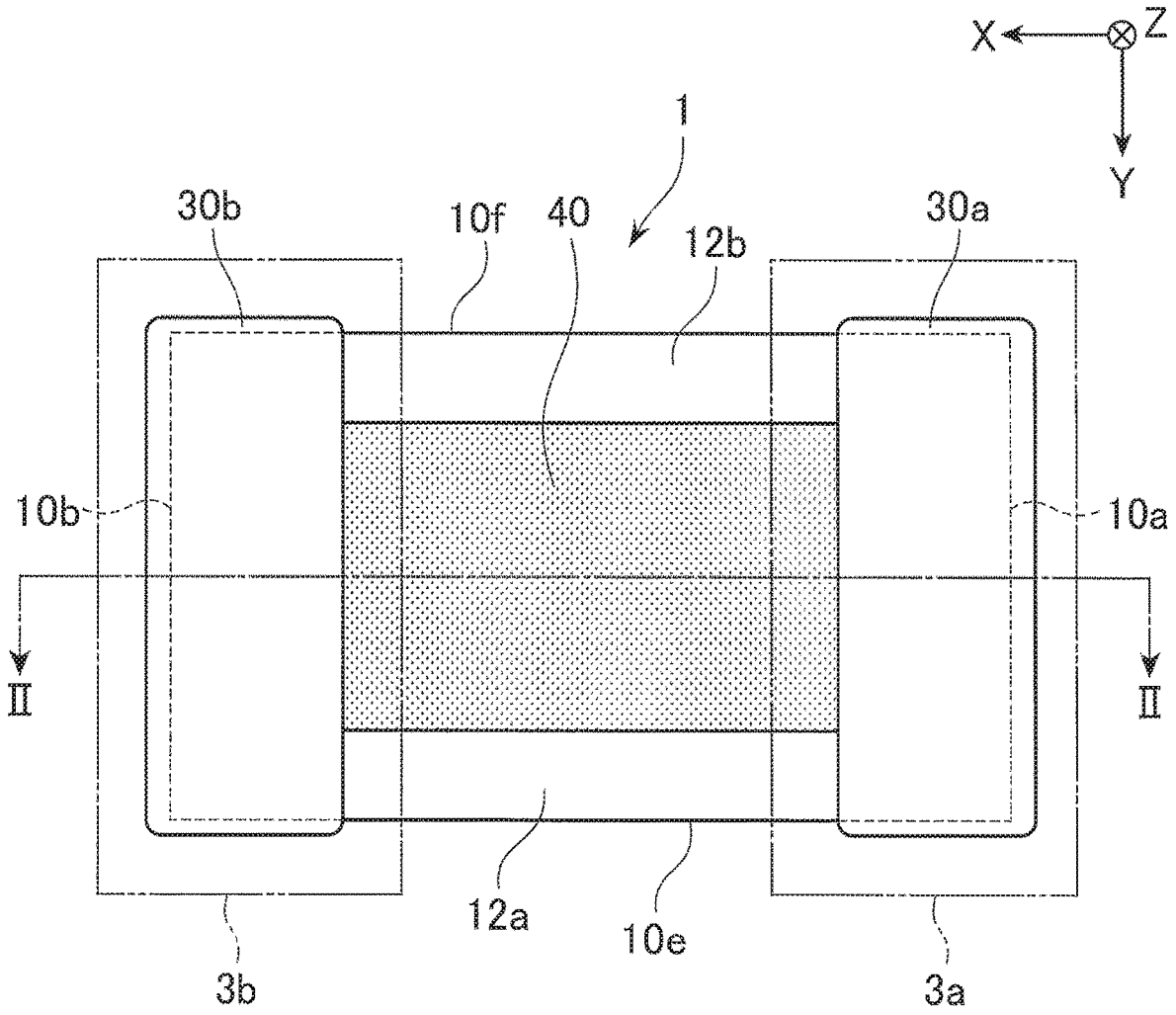
FIG. 4 is a bottom view of the coil component shown in FIG. 1.
Figure 5:
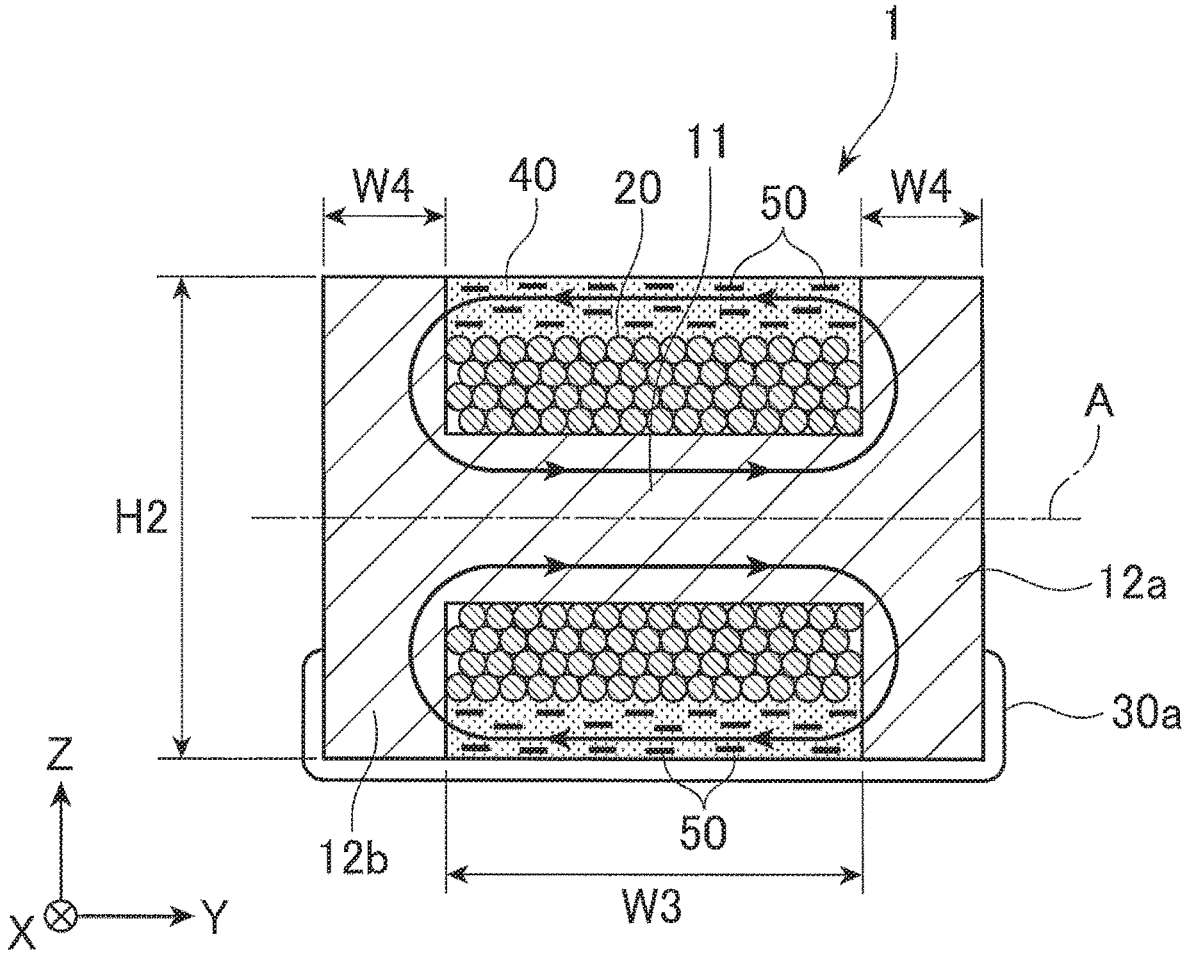
FIG. 5 is a sectional view obtained by cutting the coil component shown in FIG. 2 along a plane passing through a line I-I.
Figure 6:
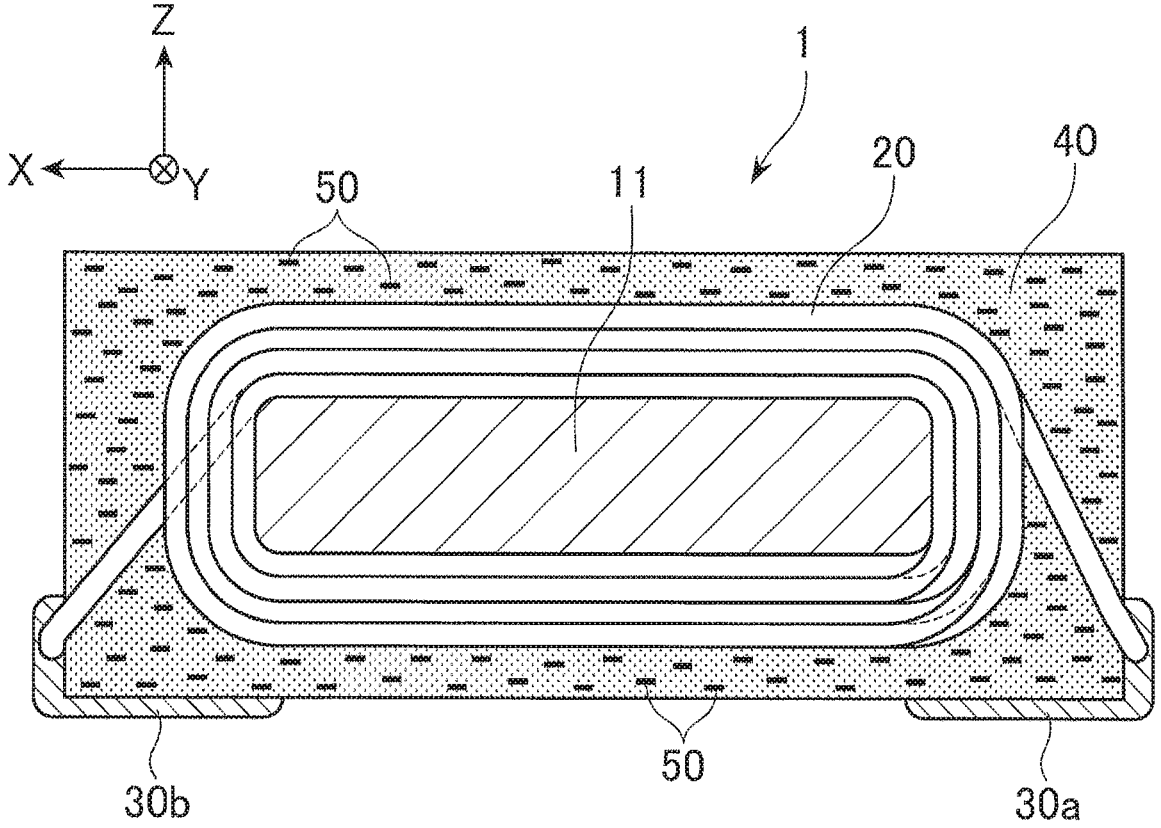
FIG. 6 is a sectional view obtained by cutting the coil component shown in FIG. 4 along a plane passing through a line II-II.

FIG. 1 is a perspective view showing a coil component according to one embodiment of the present invention, FIG. 2 is a front view thereof, FIG. 3 is a right side view thereof, and FIG. 4 is a bottom view thereof. FIG. 5 is a sectional view obtained by cutting the coil component shown in FIG. 2 along a plane passing through a line I-I, and FIG. 6 is a sectional view obtained by cutting the coil component shown in FIG. 4 along a plane passing through a line II-II.

A coil component 1 of the embodiment shown in these drawings is mounted on a circuit substrate 2 via a first land portion 3*a* and a second land portion 3*b*. The coil component 1 is, for example, an inductor used to eliminate noise in an electronic circuit. The coil component 1 may be a power inductor incorporated in a power source line or an inductor used in a signal line.

FIG. 1 shows an X direction, a Y direction, and a Z direction orthogonal to each other. In this specification, orientations and arrangements of constituent members of the coil component 1 may possibly be described relative to the X direction, the Y direction, and the Z direction shown in FIG. 1. Specifically, an extending direction of an axis A of a winding core 11 is defined as the Y direction, and a direction perpendicular to the axis A of the winding core 11 and parallel to a mounting surface of the circuit substrate 2 is defined as the X direction. Furthermore, a direction orthogonal to the X direction and the Y direction is defined as the Z direction. In this specification, the X direction may possibly be referred to as a length direction of the coil component 1, the Y direction as a width direction of the coil component 1, and the Z direction as a height direction of the coil component 1.

The coil component 1 according to one embodiment of the present invention is formed in a rectangular parallelepiped shape as shown in the drawings. The coil component 1 has a first end surface 1*a*, a second end surface 1*b*, a first principal surface 1*c* (an upper surface 1*c*), a second principal surface 1*d* (a bottom surface 1*d*), a first side surface 1*e*, and a second side surface 1*f*. More specifically, the first end surface 1*a* is an end surface of the coil component 1 in an X-axis minus direction, the second end surface 1*b* is an end surface of the coil component 1 in an X-axis plus direction, the first principal surface 1*c* is an end surface of the coil component 1 in a Z-axis plus direction, the second principal surface 1*d* is an end surface of the coil component 1 in a Z-axis minus direction, the first side surface 1*e* is an end surface of the coil component 1 in a Y-axis plus direction, and the second side surface 1*f* is an end surface of the coil component 1 in a Y-axis minus direction.

The first end surface 1*a*, the second end surface 1*b*, the first principal surface 1*c*, the second principal surface 1*d*, the first side surface 1*e*, and the second side surface 1*f* may each be a flat surface or a curved surface. Furthermore, eight corner portions of the coil component 1 may be rounded. As thus described, in this specification, even in a case where the first end surface 1*a*, the second end surface 1*b*, the first principal surface 1*c*, the second principal surface 1*d*, the first side surface 1*e*, and the second side surface 1*f* of the coil component 1 are partly curved or in a case where the corner portions of the coil component 1 are rounded, the shape of said coil component 1 may possibly be referred to as a "rectangular parallelepiped shape". That is, in this specification, a "rectangular parallelepiped" or a "rectangular parallelepiped shape" are not intended to mean a "rectangular parallelepiped" in a mathematically strict sense.

As shown in the drawings, the coil component 1 is provided with a drum core 10, a winding wire 20, a first external electrode 30*a*, a second external electrode 30*b*, and an exterior portion 40.

The drum core 10 has a winding core 11 extending in a direction parallel to the mounting surface of the circuit substrate 2, a flange 12*a* provided at one end portion of said winding core 11 and having a rectangular parallelepiped shape, and a flange 12*b* provided at the other end portion of said winding core 11 and having a rectangular parallelepiped shape. Accordingly, the winding core 11 couples the flange 12*a* to the flange 12*b*. The flange 12*a* and the flange 12*b* are disposed so that inner surfaces thereof are opposed to each other. The inner surface, an outer surface, and four surfaces connecting said inner surface to said outer surface of each of the flange 12*a* and the flange 12*b* may each be a flat surface or a curved surface. Furthermore, eight corner portions of each of the flange 12*a* and the flange 12*b* may be rounded. As thus described, in this specification, even in a case where the flange 12*a* and the flange 12*b* have a curved surface or in a case where the corner portions thereof are rounded, said shape of the flange 12*a* and the flange 12*b* may possibly be referred to as a "rectangular parallelepiped shape".

The outer surface of the flange 12*a* disposed to be opposed to the inner surface thereof and the outer surface of the flange 12*b* disposed to be opposed to the inner surface thereof each constitute part of outer surfaces of the coil component 1. The flange 12*a* and the flange 12*b* may be covered partly or entirely with the after-mentioned exterior portion 40. In this case, outer surfaces of the exterior portion 40 constitute part of the outer surfaces of the coil component 1.

Each of the flange 12*a* and the flange 12*b* is configured so that the inner surface and outer surface thereof extend in the direction perpendicular to the axis A of the winding core 11. In this specification, the terms "perpendicular", "orthogonal", and "parallel" are used without being meant in a mathematically strict sense. For example, in a case where the inner surface of the flange 12*a* extends in the direction perpendicular to the axis A of the winding core 11, an angle formed between the outer surface of the flange 12*a* and the axis A of the winding core 11 may be 90° but is only required to be substantially 90°. A range of angles of substantially 90° can include any angle within a range of 70° to 110°, 75° to 105°, 80° to 100°, or 85° to 95°. Similarly, the terms "parallel" and "orthogonal" and other terms that are included in this specification and can be interpreted in a mathematically strict sense can also be interpreted in a sense wider than the mathematically strict sense in view of the purport and contexts of the present invention and the technical common sense.

The shape of the flange 12*a* and the flange 12*b* applicable to the present invention is not limited to a rectangular parallelepiped shape, and the flange 12*a* and the flange 12*b* can be formed in various shapes. In one embodiment, one or a plurality of cutouts may be formed in the corners or sides of either or both of the flange 12*a* and the flange 12*b*. After-mentioned end portions 20*a* and 20*b* of the winding wire 20 can be bonded to the cutout(s) by thermocompression bonding.

The drum core 10 has a first end surface 10*a*, a second end surface 10*b*, a first principal surface 10*c* (an upper surface 10*c*), a second principal surface 10*d* (a bottom surface 10*d*), a first side surface 10*e*, and a second side surface 10*f*. More specifically, the first end surface 10*a* is an end surface of the drum core 10 in an X-axis minus direction, the second end surface 10*b* is an end surface of the drum core 10 in an X-axis plus direction, the first principal surface 10*c* is an end surface of the drum core 10 in a Z-axis plus direction, the second principal surface 10*d* is an end surface of the drum core 10 in a Z-axis minus direction, the first side surface 10*e* is an end surface of the drum core 10 in a Y-axis plus direction, and the second side surface 10*f* is an end surface of the drum core 10 in a Y-axis minus direction. The first end surface 10*a*, the second end surface 10*b*, the first principal surface 10*c*, the second principal surface 10*d*, the first side surface 10*e*, and the second side surface 10*f* constitute part of the first end surface 1*a*, the second end surface 1*b*, the first principal surface 1*c*, the second principal surface 1*d*, the first side surface 1*e*, and the second side surface 1*f*, respectively.

In the embodiment shown in the drawings, the winding core 11 is in a substantially quadrangular prism shape. The winding core 11 can take any shape suitable for winding the winding wire 20 thereon. For example, the winding core 11 can take a triangular prism shape, a pentagonal prism shape, a polygonal prism shape such as a hexagonal prism shape, a cylindrical column shape, an elliptical column shape, or a truncated cone shape.

The drum core 10 is made of a magnetic material or a non-magnetic material. As a magnetic material for the drum core 10, for example, ferrite, a soft magnetic metal material, or any other known magnetic material suitable for a drum core can be used. As the non-magnetic material for the drum core 10, alumina or glass can be used. A magnetic material for the drum core 10 may be any of various types of crystalline or amorphous alloy magnetic materials or a material obtained by combining a crystalline material with an amorphous material. Such a crystalline alloy magnetic material that can be used as a magnetic material for the drum core 10 is, for example, a crystalline alloy material containing Fe as a main ingredient and one or more elements selected from the group consisting of Si, Al, Cr, Ni, Ti, and Zr. Such an amorphous alloy magnetic material that can be used as a magnetic material for the drum core 10 is, for example, an amorphous alloy material containing either or both of B and C in addition to any one of Si, Al, Cr, Ni, Ti, and Zr. As a magnetic material for the drum core 10, pure iron made of Fe and inevitable impurities can be used. As a magnetic material for the drum core 10, a material obtained by combining pure iron made of Fe and inevitable impurities with any of various types of crystalline or amorphous alloy magnetic materials can also be used. A material of the drum core 10 is not limited to those explicitly described in this specification, and any known material can be used as a material of the drum core 10.

The drum core 10 is fabricated by, for example, mixing a powder of a magnetic material or a non-magnetic material as mentioned above with a lubricant, filling a mixture material thus obtained in a cavity of an injection mold, press-molding the mixture material to form a powder compact, and sintering the powder compact. Furthermore, the drum core 10 can be fabricated also by mixing a powder of a magnetic material or a non-magnetic material as mentioned above with a resin, glass, or an insulating oxide (for example, Ni—Zn ferrite or silica), molding a mixture material thus obtained, and curing or sintering the mixture material thus molded.

The winding wire 20 is wound on the winding core 11. The winding wire 20 is configured by applying an insulating coating around an electric conductor made of a metal material having excellent electrical conductivity. As a metal material for the winding wire 20, for example, one or more types of metals among Cu (copper), Al (aluminum), Ni (nickel), and Ag (silver) or an alloy containing any one of these types of metals can be used.

At least one of the flange 12*a* and the flange 12*b* has external electrodes provided at both end portions thereof in an X-axis direction, respectively. The external electrodes may be provided in both of the flange 12*a* and the flange 12*b* or in only one of them (only in the flange 12*a* or only in the flange 12*b*). FIG. 1 shows an example in which the external electrodes are provided in both of the flange 12*a* and the flange 12*b*.

In one embodiment of the present invention, each of the flange 12*a* and the flange 12*b* is configured so that a length L2 thereof in the X-axis direction (namely, a length of a long side of each of the principal surface 1*c* and the principal surface 1*d*) is longer than a distance L3 between the land portion 3*a* and the land portion 3*b*. With this configuration, each of the external electrodes provided at the end portions of the flange 12*a* and the flange 12*b* in the X-axis direction can be disposed at a position corresponding to the land portion 3*a* or the land portion 3*b* in top view. In the example shown in FIG. 1, the external electrode 30*a* provided at the end portions of the flange 12*a* and the flange 12*b* in the X-axis minus direction is disposed at a position corresponding to the land portion 3*a* in top view, and the external electrode 30*b* provided at the end portions of the flange 12*a* and the flange 12*b* in the X-axis plus direction is disposed at a position corresponding to the land portion 3*b* in top view.

More specifically, in the embodiment shown in FIG. 1, the external electrode 30*a* is provided at the end portion of the flange 12*a* in the X-axis minus direction and extends to the end portion of the flange 12*b* in the X-axis minus direction. That is, the external electrode 30*a* is provided also at the end portion of the flange 12*b* in the X-axis minus direction. On the other hand, the external electrode 30*b* is provided at the end portion of the flange 12*a* in the X-axis plus direction and extends to the end portion of the flange 12*b* in the X-axis plus direction. That is, the external electrode 30*b* is provided also at the end portion of the flange 12*b* in the X-axis plus direction.

In one embodiment of the present invention, the coil component 1 is mounted on the circuit substrate 2 by joining the external electrode 30*a* to the land portion 3*a* and joining the external electrode 30*b* to the land portion 3*b*. The external electrode 30*a* and the external electrode 30*b* are joined to the land portion 3*a* and the land portion 3*b*, respectively, via solder. With this configuration, the external electrode 30*a* electrically conducts with the land portion 3*a*, and the external electrode 30*b* electrically conducts with the land portion 3*b*.

In one embodiment of the present invention, the external electrode 30*a* is configured so as to cover an end portion of the bottom surface 10*d* of the drum core 10 in the X-axis minus direction, a region of the end surface 10*a* thereof, which extends up to a predetermined height, and a region at an end portion of each of the side surface 10*e* and the side surface 10*f* thereof in the X-axis minus direction, which extends up to a predetermined height. Similarly, the external electrode 30*b* is configured so as to cover an end portion of the bottom surface 10*d* of the drum core 10 in the X-axis plus direction, a region of the end surface 10*b* thereof, which extends up to a predetermined height, and a region at an end portion of each of the side surface 10*e* and the side surface 10*f* thereof in the X-axis plus direction, which extends up to a predetermined height.

The shape and arrangements of the external electrode 30*a* and the external electrode 30*b* shown in the drawings are illustrative only, and the external electrode 30*a* and the external electrode 30*b* can take various shapes and arrangements. The coil component 1 may be provided with a dummy electrode as appropriate in addition to the external electrode 30*a* and the external electrode 30*b*.

In one embodiment of the present invention, each of the external electrode 30*a* and the eternal electrode 30*b* has a base electrode and a plating layer covering the base layer. The base electrode is formed by, for example, applying a paste-like electrically conductive material (for example, silver) to surfaces of the drum core 10 by dipping (immersion) and drying the electrically conductive material thus applied. The plating layer formed on the base electrode is composed of, for example, two layers that are a nickel plating layer and a tin plating layer formed on said nickel plating layer. The external electrode 30*a* and the external electrode 30*b* may be formed by sputtering or vapor deposition.

One end portion of the winding wire 20 is electrically connected to the external electrode 30*a*, and the other end portion of the winding wire 20 is electrically connected to the external electrode 30*b*.

As mentioned above, the external electrode 30*a* is provided to extend from the end portion of the flange 12*b* in the X-axis minus direction to the end portion of the flange 12*a* in the X-axis minus direction, and the external electrode 30*b* is provided to extend from the end portion of the flange 12*b* in the X-axis plus direction to the end portion of the flange 12*a* in the X-axis plus direction. Thus, the both end portions of the winding wire 20 can be secured to either of the flange 12*a* and the flange 12*b*. For example, in a case where a winding start end portion of the winding wire 20 is secured to the end portion of the flange 12*b* on a minus side in the X-axis direction, while a winding finish end portion of the winding wire 20 is secured to the end portion of the flange 12*a* on a plus side in the X-axis direction, the winding wire 20 can be wound in an odd number of tiers. Particularly in a case where the winding wire 20 is wound only in one tier, a stray capacitance generated in a winding wire wound in a plurality of tiers (for example, a stray capacitance generated in a winding wire wound in two tiers between a turn of the winding wire in a first tier and a turn of the winding wire in a second tier) is prevented from being generated. With this configuration, the coil component 1 is made suitable for a high-frequency circuit. On the other hand, in a case where the winding start end portion of the winding wire 20 is secured to the end portion of the flange 12*b* on the minus side in the X-axis direction, while the winding finish end portion of the winding wire 20 is secured to the end portion of the flange 12*b* on the plus side in the X-axis direction, the winding wire 20 can be wound in an even number of tiers. With this configuration, in the coil component 1, compared with a conventional coil component in which a winding wire is wound in an odd number of tiers (one tier, three tiers, five tiers, etc.), a length of the winding wire 20 can be set easily, and there is no need for useless routing of the winding wire 20. Thus, it becomes easy to adjust an inductance value of the coil component 1.

The exterior portion 40 contains a resin and a plurality of filler particles 50. The resin contained in the exterior portion 40 is a thermosetting resin having an excellent insulation property, and examples thereof include an epoxy resin, a polyimide resin, a polystyrene (PS) resin, a high-density polyethylene (HDPE) resin, a polyoxymethylene (POM) resin, a polycarbonate (PC) resin, a polyvinylidene fluoride (PVDF) resin, a phenolic resin, a polytetrafluoroethylene (PTFE) resin, or a polybenzoxazole (PBO) resin, and any other known type of resin material used to cover a wiring wire in a wire-wound coil component.

In one embodiment of the present invention, the exterior portion 40 is formed by winding a resin sheet containing the plurality of filler particles 50 on the winding core 11. Said resin sheet is provided so as to cover at least part of the winding wire 20. In one embodiment, the exterior portion 40 is provided so as to cover all but the end portions of the winding wire 20. For example, the exterior portion 40 is provided so as to entirely cover a portion of the winding wire 20 lying between the inner surface of the flange 12*a* and the inner surface of the flange 12*b*. As thus described, the exterior portion 40 is provided around the winding core 11 so as to cover at least part of the winding wire 20 between the flange 12*a* and the flange 12*b*.

The filler particles 50 contained in the exterior portion 40 include, for example, particles of a ferrite material, metal magnetic particles, and amorphous alloy particles. As part of the plurality of filler particles 50, in addition to particles of the above-described materials, inorganic material particles such as of $SiO_2$ or $Al_2O_3$ or glass-based particles can also be contained. Particles of a ferrite material used to form the drum core 10 are, for example, particles of Ni—Zn ferrite or particles of Ni—Zn—Cu ferrite. Metal magnetic particles used to form the drum core 10 are of a material in which magnetism is developed in an unoxidized metal portion and are, for example, particles including unoxidized metal particles or alloy particles. Metal magnetic particles applicable to the present invention include particles of, for example, Fe, an Fe—Si—Cr, Fe—Si—Al, or Fe—Ni alloy, amorphous Fe—Si—Cr—B—C or Fe—Si—B—Cr, or a mixture material obtained by mixing them. A powder compact obtained from these types of particles can also be used as metal magnetic particles for the drum core 10. Moreover, these types of particles or a powder compact obtained therefrom having a surface thermally treated to form an oxidized film thereon can also be used as metal magnetic particles for the drum core 10. Metal magnetic particles for the drum core 10 are manufactured by, for example, an atomizing method. Furthermore, metal magnetic particles for the drum core 10 can be manufactured by any other known method than the atomizing method. Furthermore, commercially available metal magnetic particles can also be used as metal magnetic particles for the drum core 10. Examples of commercially available metal magnetic particles include PF-20F manufactured by Epson Atmix Corporation and SFR-FeSiAl manufactured by Nippon Atomized Metal Powders Corporation.

As shown in FIG. 5 to FIG. 8, the filler particles 50 are formed so as to have a flat shape. The flat-shaped filler particles 50 described above are formed by, for example, stirring commercially available spherical metal magnetic particles together with iron balls in a ball mill. The metal magnetic particles originally in a spherical shape are crushed by the iron balls in the ball mill and thus are deformed into a flat shape.

The filler particles 50 can be formed also by any other method than the above-described method. For example, the filler particles 50 are formed also by pulverizing foil, the foil being formed of particles of a ferrite material, pure iron made of Fe and inevitable impurities, metal magnetic particles, amorphous alloy particles, inorganic material particles such as of $SiO_2$ or $Al_2O_3$, or glass-based particles.

The exterior portion 40 may contain not only the flat-shaped filler particles 50 but also any other type of filler particles. For example, the exterior portion 40 can contain spherical filler particles in addition to the flat-shaped filler particles 50.

The filler particles 50 can include two or more types of filler particles made of different materials from each other or formed by different processing methods from each other. For example, the filler particles 50 can include filler particles of a metal magnetic material and filler particles of a ferrite material. Furthermore, the filler particles 50 can include flat-shaped particles formed by crushing spherical particles and flat-shaped particles formed by pulverizing foil.

Figure 7:
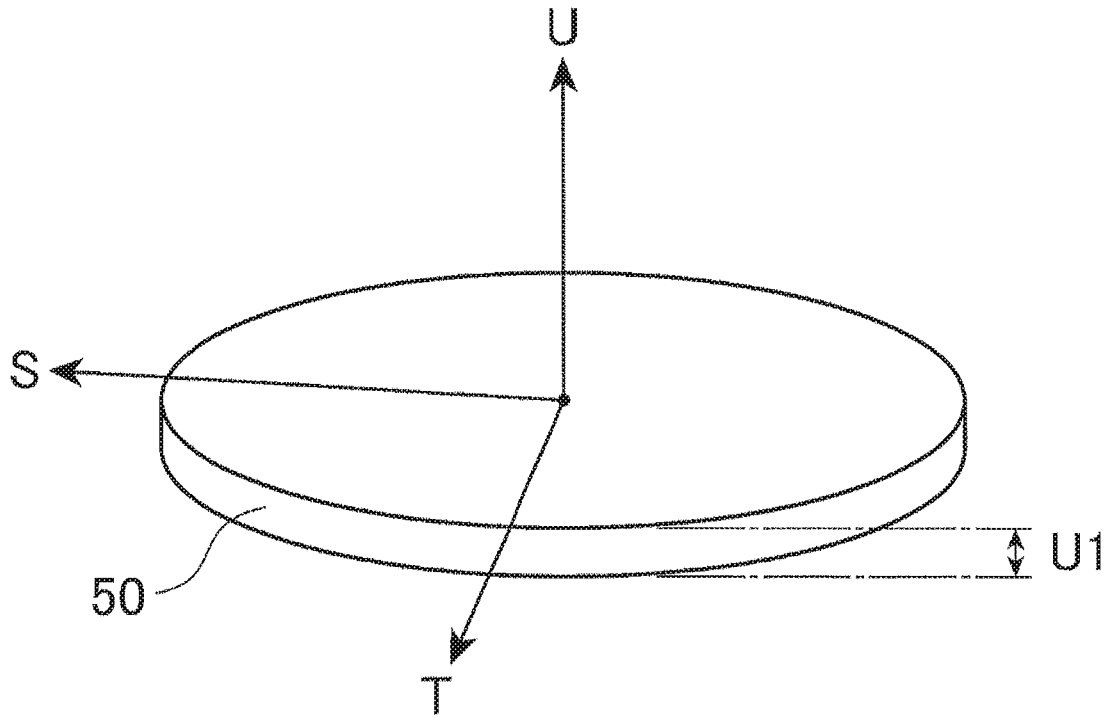
FIG. 7 is a perspective view of a filler particle contained in an exterior portion of the coil component shown in FIG. 1.
Figure 8:
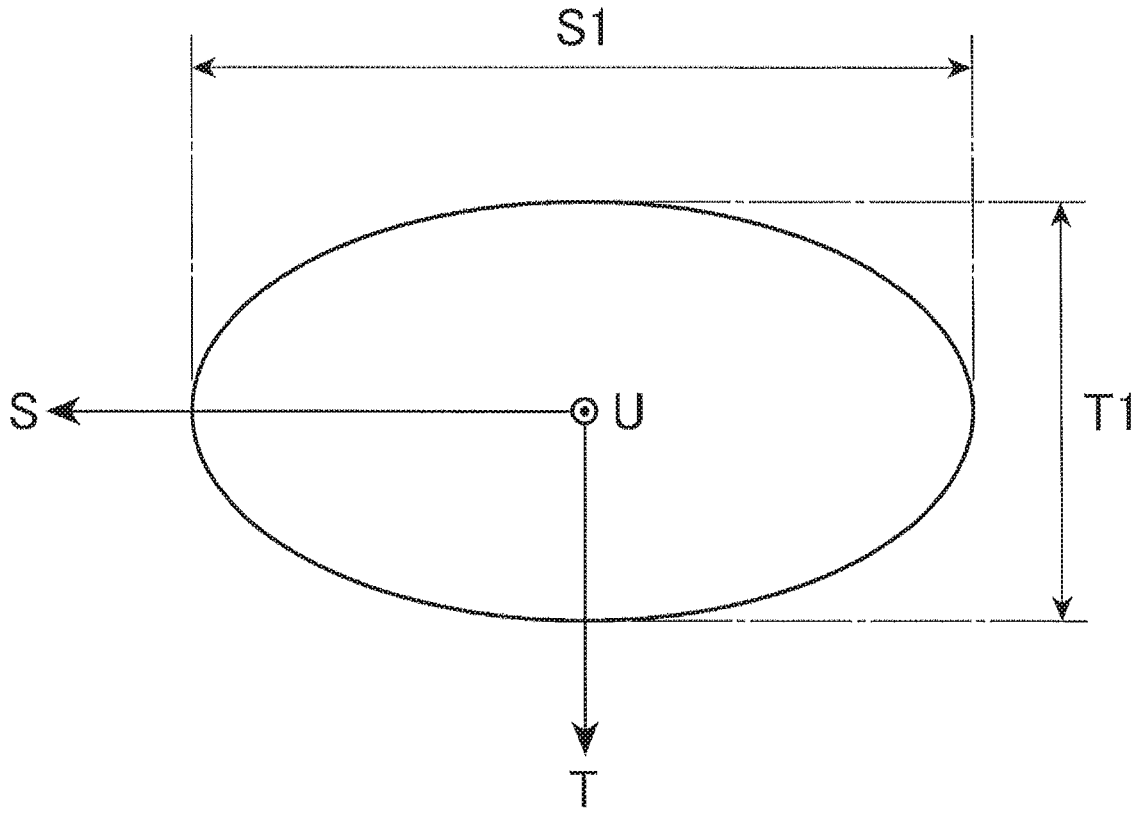
FIG. 8 is a top view of the filler particle shown in FIG. 7.

As shown in FIG. 7 and FIG. 8, each of the flat-shaped filler particles 50 applied to the present invention has, for example, a disc shape. FIG. 7 and FIG. 8 show an S direction, a T direction, and a U direction orthogonal to each other. In this specification, an orientation of the filler particles 50 may possibly be described relative to the S direction, the T direction, and the U direction shown in FIG. 7 and FIG. 8. As shown in FIG. 8, in top view, a long axis direction of the each of the filler particles 50 is defined as the S direction, and a short axis direction thereof is defined as the T direction. A U axis is an axis perpendicular to an S axis and a T axis. As described above, the each of the filler particles 50 shown in the drawings extends along a plane including the S axis and the T axis.

The each of the filler particles 50 is formed so as to have a thickness in a U-axis direction thereof equal to or larger than a predetermined thickness for prevention of breakage thereof. For example, the each of the filler particles 50 is formed so as to have a thickness U1 of 0.2 μm to 2 μm in the U-axis direction. For example, in top view, the each of the filler particles 50 is formed so as to have a width S1 in the long axis direction of 2 μm to 15 μm and a width T1 in the short axis direction of 0.2 μm to 2 μm. The width S1 of the each of the filler particles 50 in the long axis direction in top view is larger than the width T1 thereof in the short axis direction and the thickness U1 thereof in the U-axis direction, and thus the long axis direction (the S direction) of the each of the filler particles 50 in top view functions as an extending direction of a longest axis of said each of the filler particles 50. The width S1 and the width T1 of the each of the filler particles 50 can be set depending on a length of the winding core 11.

In one embodiment of the present invention, the each of the filler particles 50 is formed so that the thickness U1 thereof is smaller than either of the width Si and the width T1. That is, the each of the filler particles 50 is formed so that the U-axis direction functions as a shortest axis direction thereof. In one embodiment of the present invention, the each of the filler particles 50 is arranged so that a shortest axis thereof is oriented to the direction perpendicular to the axis A.

Each of the filler particles 50 may be formed in a circular shape in top view. In a case where each of the filler particles 50 has a circular shape in top view, however, said shape thereof in top view does not have to be a "circular" shape in a mathematically strict sense. When each of the filler particles 50 is formed in a circular shape in top view, the width S1 in the S direction and the width T1 in the T direction are equal to each other. In this case, the each of the filler particles 50 is formed so that, for example, the width S1 in the S direction and the width T1 in the T direction are each 1 μm to 30 μm. In a case where each of the filler particles 50 are formed in a circular shape in top view, the width in the S direction and the width in the T direction are substantially equal to each other, and thus the S direction and the T direction each function as a longest axis direction of the each of the filler particles 50.

In one embodiment of the present invention, each of the filler particles 50 is arranged so that a direction in which magnetic flux generated from a current flowing through the winding wire 20 is most likely to pass is oriented in a direction parallel to the axis A of the winding core 11. In each of the filler particles 50, the direction in which such magnetic flux is most likely to pass is, for example, the direction of the longest axis of the each of the filler particles 50. Accordingly, as shown in FIG. 5, each of the plurality of filler particles 50 may be arranged in the exterior portion 40 so that the longest axis thereof is oriented in the direction parallel to the axis A of the winding core 11. Therefore, in the exterior portion 40, the direction parallel to the axis A of the winding core 11 functions as an easy magnetization direction, and the direction perpendicular to the axis A functions as a hard magnetization direction. A content of the filler particles 50 is set so that, for example, a magnetic permeability in the easy magnetization direction thereof (the direction parallel to the axis A) is 20 to 70, and a magnetic permeability in the hard magnetization direction thereof (the direction perpendicular to the axis A) is 2 to 11. Each of the filler particles 50 is arranged so that, for example, the S axis thereof is oriented in the direction parallel to the axis A of the winding core 11. In a case where each of the filler particles 50 is formed in a circular shape in top view, the each of the filler particles 50 is arranged so that either the S direction thereof or the T direction thereof is oriented in the direction parallel to the axis A of the winding core 11.

As shown in FIG. 5, magnetic flux generated from a current flowing through the winding wire 20 passes through a closed magnetic circuit passing through the winding core 11, the flange 12*a*, the exterior portion 40, and the flange 12*b* and returning to the winding core 11. Accordingly, in the exterior portion 40, the magnetic flux is oriented in the direction parallel to the axis A of winding core 11. Thus, in the exterior portion 40 of the coil component 1 in the embodiment shown in the drawings, an orientation of magnetic flux and an easy magnetization direction can be made to agree with each other. With this configuration, compared with a case where the filler particles contained in the exterior portion 40 are formed in a spherical shape, it is possible to increase an effective magnetic permeability of the coil component 1 without increasing a content of said filler particles.

By use of the filler particles 50, it is possible to decrease a linear expansion coefficient of the exterior portion 40. Particularly, the filler particles 50 are aligned so that the longest axis direction thereof is oriented in the direction parallel to a direction of the axis A of the winding core 11, and thus it is possible to decrease a linear expansion coefficient in the direction of the axis A. With this configuration, even when the exterior portion 40 is heated in a manufacturing process of the coil component 1 or when the coil component 1 is in use, it is possible to make it unlikely that said exterior portion 40 is peeled off from the drum core 10. Such peeling is unlikely to occur for the following reason. That is, in the above-described embodiment, the filler particles 50 having shape anisotropy are arranged in the resin in the exterior portion 40, and thus a content of the resin in the direction parallel to the axis A of the winding core 11 is smaller than a content of the resin in the direction perpendicular to the axis A of the winding core 11. Consequently, a linear expansion coefficient of the exterior portion 40 in the direction parallel to the axis A of the winding core 11 becomes smaller than a linear expansion coefficient of the exterior portion 40 in the direction perpendicular to the axis A of the winding core 11, and thus stress is also decreased. Furthermore, a degree of intertwinement of the filler particles 50 having shape anisotropy in the direction parallel to the direction of the axis A of the winding core 11 is different from that in the direction perpendicular to the axis A of the winding core 11, and a linear expansion coefficient becomes smaller in the direction parallel to the axis A of the winding core 11 in which the degree of intertwinement of the filler particles 50 is higher.

In one embodiment of the present invention, the winding core 11 is configured to extend along a short side of the first principal surface 1*c* (the principal surface 1*d*) of the coil component 1. In the embodiment shown in FIG. 1, the coil component 1 is configured so that a dimension thereof in the X direction is larger than a dimension thereof in the Y direction, and thus the winding core 11 can be made to extend along the short side of the principal surface 1*c* of the coil component 1.

In another embodiment of the present invention, the coil component 1 is configured so that a dimension thereof in the X direction is smaller than a dimension thereof in the Y direction. In this case, a side of the principal surface 1*c* (the principal surface 1*d*) of the coil component 1 parallel to the Y direction functions as a long side. Accordingly, in one embodiment of the present invention, the coil component 1 is configured so that the winding core 11 extends along the long side of the principal surface 1*c* (the principal surface 1*d*) of the coil component 1.

A description is give of an example of dimensions of the coil component 1 and the various constituent components thereof. The coil component 1 is formed so that, for example, a length dimension (a dimension in the X direction) L1 is 1 mm to 2.6 mm, a width dimension (a dimension in the Y direction) W1 is 0.5 mm to 2.1 mm, and a height dimension (a dimension in the Z direction) H1 is 0.3 mm to 1.05 mm. In one embodiment, the coil component 1 is configured so that the dimension L1 in a length direction is 2.0 mm, the dimension W1 in a width direction is 1.2 mm, and the dimension H1 in a height direction is 0.8 mm. These dimensions are illustrative only, and a coil component to which the present invention is applicable can take any dimensions unless diverged from the purport of the present invention.

In one embodiment of the present invention, the drum core 10 is formed so that a length dimension (a dimension in the X direction) L2 is 1.0 mm to 2.5 mm, a width dimension (a dimension in the Y direction) W2 is 0.5 mm to 2.0 mm, and a height dimension (a dimension in the Z direction) H2 is 0.3 mm to 1.0 mm. In one embodiment of the present invention, the drum core 10 is formed so that a ratio (H2/L2) of the dimension H2 in a height direction to the dimension L2 in a length direction is 0.2 to 0.5.

In one embodiment of the present invention, a length W3 of the winding core 11 of the drum core 10 is set to 0.9 mm. The length W3 of the winding core 11 is equal to a distance between the two flanges 12*a* and 12*b*, i.e., a distance from the inner surface of the flange 12*a* to the inner surface of the flange 12*b*.

In one embodiment of the present invention, a cross section of the winding core 11 of the drum core 10 perpendicular to the axis A is set to have a length in the X direction of 1.4 mm and a thickness in the Z direction of 0.4 mm.

In one embodiment of the present invention, a dimension (a dimension in the Y direction) W4 of each of the flange 12*a* and the flange 12*b* of the drum core 10 in the direction parallel to the axis A of the winding core 11 is set to 0.15 mm.

In one embodiment of the present invention, each of the flange 12*a* and the flange 12*b* is configured so that the thickness (a height) H2 in a Z-axis direction is larger than the thickness W4 in the direction parallel to the axis A of the winding core 11.

The coil component 1 in one embodiment of the present invention is configured so that the length W3 of the winding core 11 in an axis direction is shorter than the distance L3 between the land portion 3*a* and the land portion 3*b*.

The above-mentioned dimensions of the various portions of the drum core 10 are illustrative only, and a drum core used in a coil component to which the present invention is applicable can take any dimensions unless diverged from the purport of the present invention.

In one embodiment of the present invention, the winding core 11 is formed so that a distance H3 between an upper surface 11*a* on an outer periphery thereof and the upper surface 10*c* of the drum core 10 is equal to a distance L4 between a side surface 11*c* on said outer periphery and the end surface 10*a* of the drum core 10.

Subsequently, with reference to FIG. 9 and FIG. 10, a description is given of a method for manufacturing the coil component 1 according to one embodiment of the present invention. FIG. 9 and FIG. 10 are schematic views explaining the method for manufacturing the coil component 1. FIG. 9 schematically shows a view of the coil component 1 in the course of being manufactured as seen from a cross section obtained by cutting the coil component 1 along a plane passing through a line II-II, and FIG. 10 schematically shows a view of the coil component 1 in the course of being manufactured as seen from a right side surface thereof.

Figure 9A:
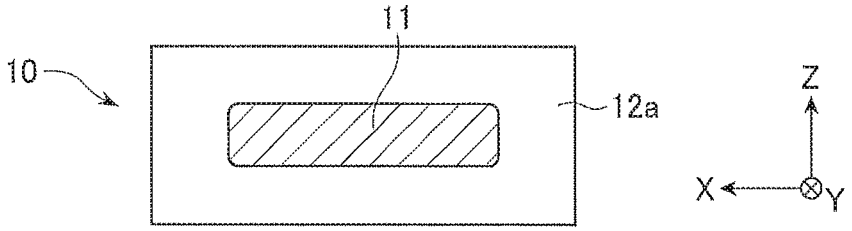
FIG. 9A is a schematic view showing a method for manufacturing the coil component according to one embodiment of the present invention.
Figure 10A:
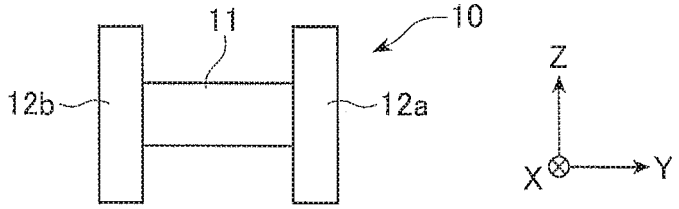
FIG. 10A is a schematic view showing the method for manufacturing the coil component according to one embodiment of the present invention.

First, as shown in FIG. 9A and FIG. 10A, the drum core 10 is prepared. The drum core 10 can be fabricated by any known technique. For example, as disclosed in Japanese Patent Application Publication No. Hei 05-226156, the drum core 10 having the flanges 12*a* and 12*b* and the winding core 11 can be formed by press-molding. Furthermore, the drum core 10 having the flanges 12*a* and 12*b* and the winding core 11 can be formed also by performing, in combination, press-molding and grinding with respect to a thus obtained molded body having a rotation reference plane.

Next, a silver paste is made to adhere to a lower portion of the flange 12*a* by dipping (immersion), and the silver paste is dried to form a first base electrode (not shown) at an end of the flange 12*a* near the side surface 10*a* of the drum core 10 and a second base electrode (not shown) at an end portion of the flange 12*a* near the side surface 10*b* of the drum core 10. The first base electrode and the second base electrode are provided at the flange 12*a* so as to be separated from each other by a predetermined distance in the X direction of the coil component 1. The base electrodes can be formed by, in addition to dipping, various known techniques such as brush coating, transfer, printing, a thin film process, attachment of a metal plate, and attachment of a metal tape.

Figure 9B:
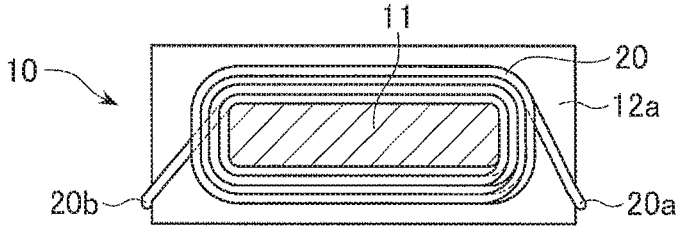
FIG. 9B is a schematic view showing the method for manufacturing the coil component according to one embodiment of the present invention.
Figure 10B:
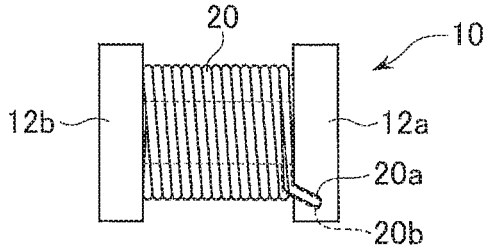
FIG. 10B is a schematic view showing the method for manufacturing the coil component according to one embodiment of the present invention.

Next, as shown in FIG. 9B and FIG. 10B, the winding wire 20 is wound a predetermined number of turns on the winding core 11. The one end portion 20*a* of the winding wire 20 is bonded to the first base electrode by thermocompression bonding, and the other end 20*b* of the winding wire 20 is bonded to the second base electrode by thermocompression bonding. The winding wire 20 can be secured to the base electrodes also by, in addition to thermocompression bonding, various other known techniques. For example, the winding wire 20 can be secured to a corresponding one of the base electrodes by brazing with a metal, adhesion with a heat-resistant adhesive, sandwiching using a metal plate, or a combination of these.

Figure 9C:
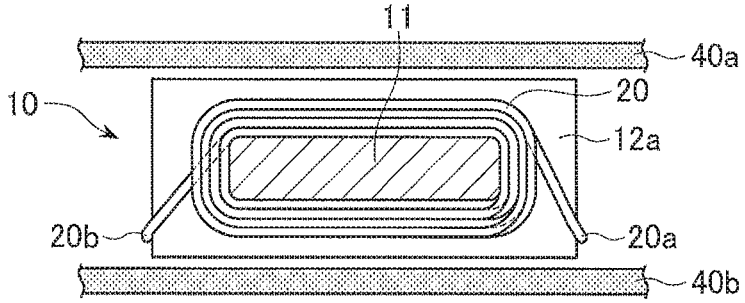
FIG. 9C is a schematic view showing the method for manufacturing the coil component according to one embodiment of the present invention.
Figure 10C:
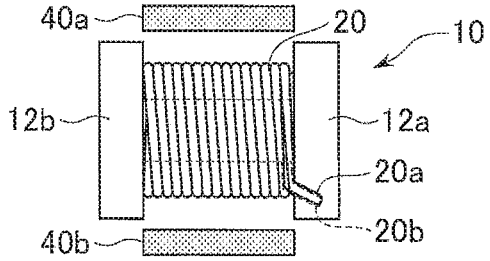
FIG. 10C is a schematic view showing the method for manufacturing the coil component according to one embodiment of the present invention.

Next, as shown in FIG. 9C and FIG. 10C, a resin sheet 40*a* and a resin sheet 40*b* are prepared. The resin sheet 40*a* and the resin sheet 40*b* are formed in the following manner. First, a kneaded composition is obtained by kneading a thermosetting resin together with the filler particles 50 formed in a flat shape. Next, said kneaded composition is applied on a substrate so that a sheet body having a thickness two or more times larger than a height of the drum core 10 is obtained. Next, said sheet body is rolled while being heated at about 120° C. The sheet body after being rolled is set to have a thickness about one-half the thickness of the sheet body before being rolled. By this rolling process, a content ratio of the filler particles 50 in said sheet body (a ratio of the filler particles 50 to the resin) can be adjusted to a desired ratio. The sheet body after being rolled is cut so as to have a width substantially equal to a distance between the flange 12*a* and the flange 12*b*, and thus the elongated resin sheets 40*a* and 40*b* are obtained.

Figure 9D:
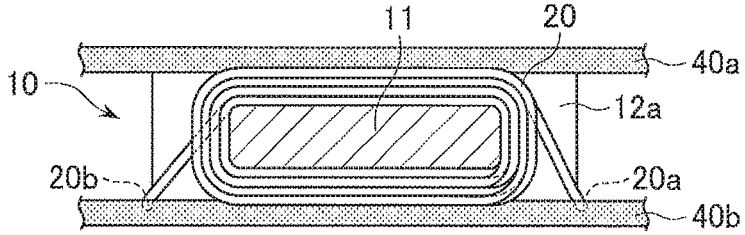
FIG. 9D is a schematic view showing the method for manufacturing the coil component according to one embodiment of the present invention.
Figure 10D:
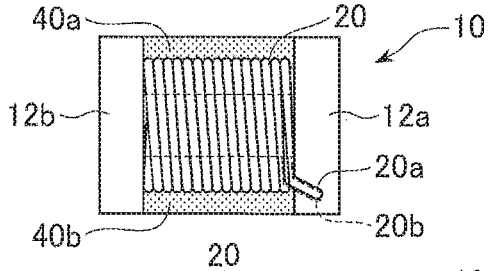
FIG. 10D is a schematic view showing the method for manufacturing the coil component according to one embodiment of the present invention.

Next, as shown in FIG. 9D and FIG. 10D, from near the upper surface 10*c* of the drum core 10, the resin sheet 40*a* is inserted between the flange 12*a* and the flange 12*b*, and, similarly, from near the lower surface 10*d* of the drum core 10, the resin sheet 40*b* is inserted between the flange 12*a* and the flange 12*b*.

Figure 9E:
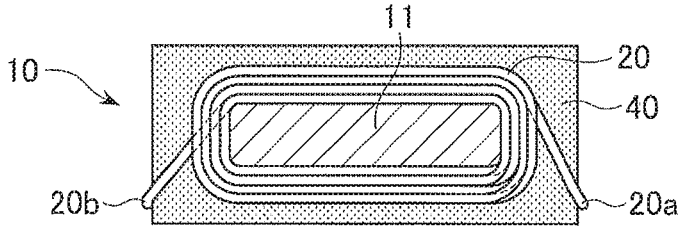
FIG. 9E is a schematic view showing the method for manufacturing the coil component according to one embodiment of the present invention.
Figure 10E:
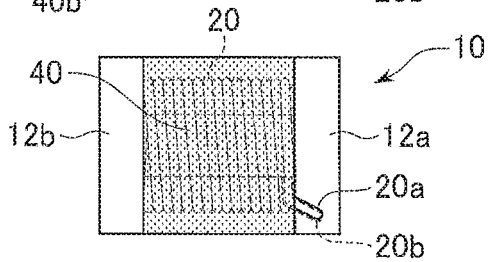
FIG. 10E is a schematic view showing the method for manufacturing the coil component according to one embodiment of the present invention.

Next, as shown in FIG. 9E and FIG. 10E, the resin sheet 40*a* and the resin sheet 40*b* inserted between the flange 12*a* and the flange 12*b* are wound around the winding core 11 so as to cover the winding wire 20, thus forming the exterior portion 40. That is, the resin sheet 40*a* and the resin sheet 40*b* wound around the winding core 11 so as to cover the winding wire 20 between the flange 12*a* and the flange 12*b* form the exterior portion 40. The resin sheet 40*a* and the resin sheet 40*b* are wound so that the end portion 20*a* and the end portion 20*b* of the winding wire 20 are exposed from the exterior portion 40.

Figure 9F:
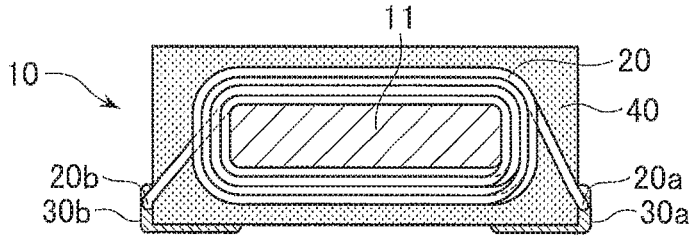
FIG. 9F is a schematic view showing the method for manufacturing the coil component according to one embodiment of the present invention.
Figure 10F:
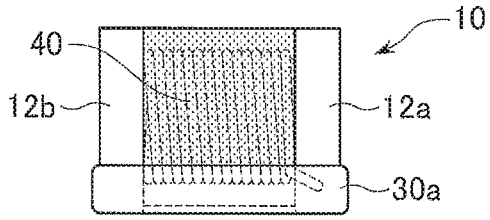
FIG. 10F is a schematic view showing the method for manufacturing the coil component according to one embodiment of the present invention.

Next, as shown in FIG. 9F and FIG. 10F, at an end portion near the end surface 10*a* in the width direction (the X direction), a silver paste is applied to the bottom surface 10*d* of the drum core 10 and the region of the end surface 10*a* thereof, which extends up to a predetermined height, thus forming the external electrode 30*a*. Similarly, also at an end portion near the end surface 10*b* in the width direction (the X direction), a silver paste is applied to the bottom surface 10*d* of the drum core 10 and the end surface 10*b* thereof, which extends up to a predetermined height, thus forming the external electrode 30*b*. The external electrode 30*a* is formed so as to be electrically connected to the end portion 20*a* of the winding wire 20, and the external electrode 30*b* is formed so as to be electrically connected to the end portion 20*b* of the winding wire 20.

The flange 12*a* and the flange 12*b* or the exterior portion 40 are partly subjected to polishing as required.

In the above-described manner, the coil component 1 having a smoothed surface and a reduced thickness is fabricated.

In the above-described process of manufacturing the coil component 1, the resin sheet 40*a* and the resin sheet 40*b* are cut into a desired size as appropriate. For example, in the process step shown in FIG. 9E and FIG. 10E, when the resin sheet 40*a* or the resin sheet 40*b* has a length longer than necessary in the X-axis direction, an end portion thereof in the X-axis direction is cut out.

According to the above-mentioned coil component 1 of one embodiment of the present invention, as mentioned above, the axis A of the winding core 11 is provided to extend along the short side (the side in the Y direction) of the coil component 1, and thus compared with a coil component configured so that an axis of a winding core extends in a long side direction of the coil component, the winding core 11 is unlikely to be destroyed.

The coil component 1 in one embodiment of the present invention is configured so that the length W3 of the winding core 11 in the axis direction is shorter than the distance L3 between the land portion 3*a* and the land portion 3*b*. In the conventional coil component, since the pair of flanges are disposed at positions corresponding to the corresponding pair of land portions, respectively, the winding core connecting the pair of flanges to each other has a length equal to or longer than a distance between the pair of land portions. According to said embodiment, the length W3 of the winding core 11 in the axis direction is smaller than the distance L3 between the land portions 3*a* and 3*b*, and thus the winding core 11 can be made shorter than that of the winding core in the conventional coil component. Accordingly, the winding core 11 of the coil component 1 according to said embodiment is unlikely to be destroyed due to stress compared with the conventional coil component.

In the above-mentioned coil component 1 according to one embodiment of the present invention, each of the flange 12*a* and the flange 12*b* is configured so that the thickness (the height) H2 in the Z-axis direction is larger than the thickness W4 in the direction parallel to the axis A and thus has a high bending resistance against stress in the Z-axis direction. Accordingly, even when large stress toward the Z-axis direction (a direction perpendicular to the circuit substrate 2) is exerted on the coil component 1 at a time of mounting to the circuit substrate 2, the flange 12*a* and the flange 12*b* are unlikely to be destroyed.

In the above-mentioned coil component 1 according to one embodiment of the present invention, the flange 12*a* and the flange 12*b* are arranged to extend astride the first land portion 3*a* and the second land portion 3*b*. With this configuration, even when large stress toward the Z-axis direction (the direction perpendicular to the circuit substrate 2) is exerted on the coil component 1 at a time of mounting to the circuit substrate 2, said stress can be received by the flange 12*a* and the flange 12*b*. As a result, the coil component 1 has a high bending resistance against stress in the Z-axis direction.

Furthermore, according to the above-mentioned coil component 1 of one embodiment of the present invention, the winding core 11 has improved strength, and thus the coil component 1 can be further reduced in thickness. Furthermore, the distance H3 between the upper surface 11*a* of the winding core 11 on the outer periphery thereof and the upper surface 10*c* of the drum core 10 is set to be equal to or larger than a distance H4 between a lower surface 11*b* of the winding core 11 on the outer periphery thereof and the lower surface 10*d* of the drum core 10. Thus, it is possible to make it unlikely that a thermal influence is exerted at a time of connection between the winding wire 20 and the external electrodes 30*a* and 30*b* or a time of mounting to the circuit substrate 2 or that an electrical influence is exerted from said circuit substrate 2 after the mounting to the circuit substrate 2.

Furthermore, the distance L4 between the side surface 11*c* of the winding core 11 on the outer periphery thereof and the end surface 10*a* of the drum core 10 is set to be equal to a distance L5 between a side surface 11*d* of the winding core 11 on the outer periphery thereof and the end surface 10*b* of the drum core 10, and thus it is no longer required to align the drum core 10 in the X direction.

Furthermore, according to the above-mentioned coil component 1 of one embodiment of the present invention, the winding core 11 is improved in strength, and thus the degree of freedom in designing a cross section perpendicular to the axis A of the winding core 11 is increased. With this configuration, for example, by decreasing a diameter of the winding core 11, the capability of accommodating the winding wire 20 can be improved. This configuration also makes it possible for a winding wire having an increased wire diameter to be used as the winding wire 20. When such a winding wire having an increased wire diameter is used as the winding wire 20, the winding wire 20 can be decreased in resistance value. Such a coil component thus decreased in resistance value is suitable for use as a power inductor.

Furthermore, since the degree of freedom in designing a cross section perpendicular to the axis A of the winding core 11 is increased, in a magnetic path passing through the winding core 11, the flange 12*a*, and the flange 12*b*, it becomes easier to set the winding core 11, the flange 12*a*, and the flange 12*b* to have a uniform cross-sectional area in a direction perpendicular to said magnetic path.

The dimensions, materials, and arrangements of the various constituent components described in this specification are not limited to those explicitly described in the embodiments, and the various constituent components can be modified to have any dimensions, materials, and arrangements within the scope of the present invention. Furthermore, constituent components not explicitly described in this specification can also be added to the embodiments described, and some of the constituent components described in the embodiments can also be omitted.

For example, as the coil component 1, a four-terminal type coil component having four external electrodes can also be used. In the four-terminal type coil component, in place of the winding wire 20, two winding wires electrically insulated from each other are wound around the winding core 11. Both end portions of each of the two winding wires are each connected to an appropriate one of the four external electrodes. Such a coil component having four terminals can be used as a common mode choke coil, a transformer, or any other type of coil component required to have a high coupling coefficient.

In a case where the coil component 1 is used as a transformer having an intermediate terminal, it may also be possible that an intermediate flange is provided between the flange 12*a* and the flange 12*b*, and an external electrode that functions as the intermediate terminal is provided at the intermediate flange.

In a case where the coil component 1 is used as a common mode choke coil having three systems of winding wires, a configuration can be adopted in which an intermediate flange is provided between the flange 12*a* and the flange 12*b*, and an external electrode for one of the winding wires that is dedicated to the third system is provided at the intermediate flange. For example, C-PHY developed by the MIPI Alliance stipulates that three signal lines per lane are used to differentially transmit a signal. The coil component 1 can be used as a common mode choke coil conforming to C-PHY.

The coil component 1 may be disposed so that the winding core 11 of the drum core 10 extends in a direction perpendicular to the mounting surface of the circuit substrate 2. In this case, the coil component 1 is mounted on the circuit substrate 2 in a portrait orientation.

What is claimed is:

1. A coil component, comprising:

a drum core having a first flange, a second flange, and a winding core coupling said first flange to said second flange;

a winding wire wound on the winding core; and an exterior portion provided around the winding core so as to be in direct contact with at least part of the winding wire and having an easy magnetization direction oriented parallel to an axis of the winding core, wherein a first linear expansion coefficient of the exterior portion in the direction parallel to the axis of the winding core is smaller than a second liner expansion coefficient of the exterior portion in a direction perpendicular to the axis of the winding core.

2. The coil component according to claim 1, wherein the exterior portion contains a resin and a first plurality of filler particles having a flat shape, and each of the first plurality of filler particles is contained in the exterior portion so that a longest axis thereof is oriented in the direction parallel to the axis of the winding core.

3. The coil component according to claim 1, wherein the winding core extends in a direction parallel to a principal surface of the coil component.

4. The coil component according to claim 3, wherein the axis of the winding core extends in a short side direction of the principal surface.

5. The coil component according to claim 3, wherein the axis of the winding core extends in a long side direction of the principal surface.

6. The coil component according to claim 1, further comprising:

a first external electrode provided at the first flange and electrically connected to one end portion of the winding wire; and a second external electrode provided at the first flange and electrically connected to another end portion of the winding wire.

7. The coil component according to claim 1, further comprising:

a first external electrode provided at the first flange and electrically connected to one end portion of the winding wire; and a second external electrode provided at the second flange and electrically connected to another end portion of the winding wire.

8. The coil component according to claim 1, wherein the winding wire is wound only in one tier on the winding core.

9. The coil component according to claim 1, wherein each of the first flange and the second flange is configured so that a thickness thereof in a direction perpendicular to the principal surface is larger than a thickness thereof in the direction parallel to the axis of the winding core.

10. The coil component according to claim 2, wherein the exterior portion contains a second plurality of filler particles having a spherical shape.

* * * * *